US008400377B2

(12) United States Patent
Hwang

(10) Patent No.: US 8,400,377 B2
(45) Date of Patent: Mar. 19, 2013

(54) PIXEL AND ORGANIC LIGHT EMITTING DISPLAY DEVICE USING THE SAME

(75) Inventor: Young-In Hwang, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 12/987,026

(22) Filed: Jan. 7, 2011

(65) Prior Publication Data

US 2012/0019505 A1 Jan. 26, 2012

(30) Foreign Application Priority Data

Jul. 20, 2010 (KR) ..... 10-2010-0069940

(51) Int. Cl.
*G09G 3/30* (2006.01)

(52) U.S. Cl. ..... 345/76; 345/211; 345/82; 315/169.3

(58) Field of Classification Search ..... 345/204, 345/211, 76–83, 212; 315/169.3; 257/88
See application file for complete search history.

(56) References Cited

U.S. PATENT DOCUMENTS

2005/0017934 A1 1/2005 Chung et al.
2006/0038754 A1* 2/2006 Kim ..... 345/76
2008/0150844 A1* 6/2008 Choi ..... 345/76
2009/0201231 A1* 8/2009 Takahara et al. ..... 345/76
2011/0025586 A1* 2/2011 Lee ..... 345/76
2011/0025671 A1* 2/2011 Lee ..... 345/211

FOREIGN PATENT DOCUMENTS

JP 2006106568 A * 4/2006
KR 10-2005-0005646 1/2005
KR 10-2007-0083072 8/2007

OTHER PUBLICATIONS

English Translation of JP 2006-106568.*

* cited by examiner

*Primary Examiner* — Hong Zhou
(74) *Attorney, Agent, or Firm* — Christie, Parker & Hale, LLP

(57) ABSTRACT

A pixel includes: an organic light emitting diode; a first transistor having a second electrode coupled with the organic light emitting diode and a first electrode coupled with a data line; a second transistor coupled between a gate electrode and the second electrode of the first transistor and turned on when a first scan signal is supplied to a first scan line; a third transistor coupled between the first electrode of the first transistor and the data line and turned on when a second scan signal is supplied to the second scan line; a first capacitor coupled between the first electrode of the first transistor and a first power supply; and a second capacitor coupled between the gate electrode of the first transistor and the first power supply.

14 Claims, 5 Drawing Sheets

PIXEL AND ORGANIC LIGHT EMITTING DISPLAY DEVICE USING THE SAME

CROSS-REFERENCE TO RELATED APPLICATIONS

This application claims priority to and the benefit of Korean Patent Application No. 10-2010-0069940, filed on Jul. 20, 2010, in the Korean Intellectual Property Office, the entire content of which is incorporated herein by reference.

BACKGROUND

1. Field of the Invention

Aspects of embodiments according to the present invention relate to a pixel and an organic light emitting display device using the pixel, and an organic light emitting display device using the pixel.

2. Description of Related Art

A variety of flat panel displays which are lighter and smaller than cathode ray tubes have been recently developed. Various flat panel displays include liquid crystal displays (LCDs), field emission displays (FEDs), plasma display panels (PDPs), and an organic light emitting display devices, etc.

The organic light emitting display device displays an image, using an organic light emitting diode that produces light by recombining electrons and holes. Generally, organic light emitting display devices have a high response speed and are driven by low power.

FIG. 1 is a circuit diagram illustrating a pixel of an organic light emitting display device in the related art.

Referring to FIG. 1, a pixel 4 of an organic light emitting display device of the related art includes: an organic light emitting diode (OLED); and a pixel circuit 2 coupled to a data line Dm and a scan line Sn, for controlling the organic light emitting diode OLED.

The anode electrode of the organic light emitting diode OLED is coupled to the pixel circuit 2 and the cathode electrode is coupled to the second power supply ELVSS. The organic light emitting diode produces light with luminance according to the current supplied from the pixel circuit 2.

The pixel circuit 2 controls the amount of current supplied to the organic light emitting diode OLED, in response to a data signal supplied to the data line Dm, when a scan signal is supplied to the scan line Sn. For this configuration, the pixel circuit 2 includes: a second transistor M2 coupled between a first power supply ELVDD and the organic light emitting diode OLED; a first transistor M1 coupled between the second transistor M2, the data line Dm, and the scan line Sn; and a storage capacitor Cst coupled between a gate electrode and a first electrode of the second transistor M2.

A gate electrode of the first transistor M1 is coupled to the scan line Sn and a first electrode is coupled to the data line Dm. Further, a second electrode of the first transistor M1 is coupled to one terminal of the storage capacitor Cst. In this configuration, the first electrode is any one of a source electrode and a drain electrode and the second electrode is the other electrode different from the first electrode. For example, when the first electrode is the source electrode, the second electrode is the drain electrode. When the first transistor M1 coupled to the scan line Sn and the data line Dm is turned on and supplies a data signal, the date is supplied through the data line Dm, to the storage capacitor Cst. In this operation, the storage capacitor Cst is charged at voltage corresponding to the data signal.

The gate electrode of the second transistor M2 is coupled to one terminal of the storage capacitor Cst and the first electrode is coupled to the first power supply ELVDD and the other terminal of the storage capacitor Cst. Further, the second electrode of the second transistor M2 is coupled to the anode of the organic light emitting diode OLED. The second transistor M2 controls the amount of current flowing from the first power supply ELVDD to the second power supply ELVSS through the organic light emitting diode OLED, in response to the voltage value stored in the storage capacitor Cst. In this configuration, the organic light emitting diode OLED emits light according to the amount of current supplied from the second transistor M2.

However, the pixel 4 of the organic light emitting display device of the related art cannot display an image with uniform luminance. To be more specific, the second transistors M2 (driving transistors) in the pixels 4 have different threshold voltages for each pixel 4 due to manufacturing variations. Because the threshold voltages of the driving transistors are different, light with different luminances are generated by the differences in the threshold voltages of the driving transistors, even if data signals corresponding to the same gradation are supplied to the pixels 4.

In order to overcome the luminance differences, a structure using six transistors and one capacitor for each pixel 4 to compensate for the threshold voltage of a driving transistor has been disclosed (Korean Patent Publication No. 2007-0083072). However, the six transistors included in the pixel 4 complicate the pixel 4. In particular, the possibility of malfunction is increased, and yield is correspondingly decreased by the additional transistors in the pixels.

SUMMARY

Accordingly, an aspect of the present invention provides a pixel having a simple structure and configured to compensate for the threshold voltage of a driving transistor, and an organic light emitting display device using the pixel.

According to one embodiment of the present invention, a pixel is provided including: an organic light emitting diode; a first transistor having a second electrode coupled to the organic light emitting diode and a first electrode coupled to a data line; a second transistor coupled between a gate electrode and the second electrode of the first transistor and turned on when a first scan signal is supplied to a first scan line; a third transistor coupled between the first electrode of the first transistor and the data line and turned on when a second scan signal is supplied to a second scan line; a first capacitor coupled between the first electrode of the first transistor and a first power supply; and a second capacitor coupled between the gate electrode of the first transistor and the first power supply.

The second transistor and the third transistor may be concurrently turned on for one frame period while the second capacitor is charged.

The second transistor may be turned on for a longer time than the third transistor during a scan period.

The pixel may further include a fourth transistor coupled between the first power supply and the data line and turned on except during a scan period.

According to another embodiment of the present invention an organic light emitting display device of which one frame period is divided into an initializing period, a scan period, and an emission period, the organic light emitting display device including: a pixel unit including pixels coupled with first scan lines, second scan lines, and data lines; a data driver for driving output lines; a first power driver for supplying first power, changing to a low level and a high level during the frame period, to a first power line and a second power line, the second power line coupled to the pixels; connection units coupled between the output lines and data lines, the connection units for connecting the data lines with the first power line and one of the output lines; and a second power driver for supplying a second power, changing to a low level and a high level during the frame period, to the pixels.

The first power driver may be configured to supply the first power at the low level for the initializing period and to supply the first power at the high level for the scan period and the emission period.

The organic light emitting display device as claimed in claim 5, wherein second power driver is configured to supply the second power at the high level for the initializing period and the scan period, and to supply the second power at the low level for the emission period.

The pixels may each include an organic light emitting diode; a first transistor including a second electrode coupled to the organic light emitting diode and a first electrode coupled to a data line; a second transistor coupled between a gate electrode and the second electrode of the first transistor, and turned on when a first scan signal is supplied to a first scan line; a third transistor coupled between the first electrode of the first transistor and the data line, and turned on when a second scan signal is supplied to the second scan line; a first capacitor coupled between the first electrode of the first transistor and a second power line; and a second capacitor coupled between the gate electrode of the first transistor and the second power line.

The scan driving unit may concurrently supply second scan signals to the second scan lines for the initializing period and the emission period, and sequentially supply the second scan signals to the second scan lines for the scan period.

The scan driving unit may concurrently supply first scan signals to the first scan lines for a predetermined period in the initializing period, and sequentially supply the first scan signals to the first scan lines for the scan period.

The first scan signal supplied to an i-th (herein, i is a natural number) first scan line of the first scan lines for the scan period may be supplied concurrently with the second scan signal supplied to an i-th second scan line of the second scan lines, and the first scan signal may be supplied for a time longer than the second scan signal.

The organic light emitting display device may further include a control signal generator for supplying a first control signal corresponding to a connection between the data line and the output line for the scan period, and a second control signal corresponding to a connection between the data line and the first power line for the initializing period and for the emission period to the connection unit.

The pixels may each further include a fourth transistor coupled between the second power line and the data line and turned on when the second control signal is supplied.

The connection unit may include: a first control transistor coupled between the output line and the data line and turned on when the first control signal is supplied; and a second control transistor coupled between the first power line and the data line and turned on when the second control signal is supplied.

According to one embodiment of the present invention, a pixel and an organic light emitting display device using the pixel, may compensate for a threshold voltage of a driving transistor while reducing or minimizing the number of transistors included in the pixel.

BRIEF DESCRIPTION OF THE DRAWINGS

The above and other aspects and features of the embodiments according to the present invention will be more clearly understood from the following detailed description taken in conjunction with the accompanying drawings, in which.

DETAILED DESCRIPTION

Figure 1:
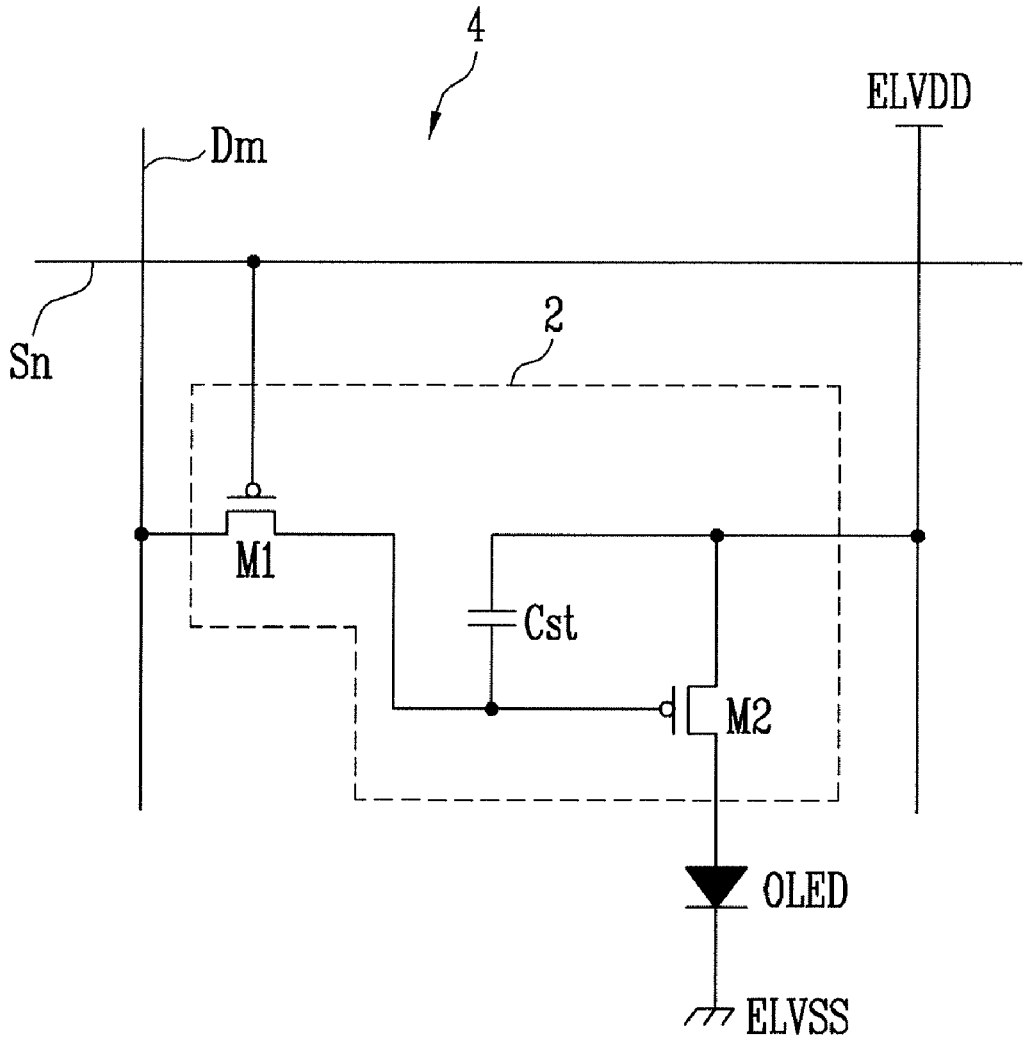
FIG. 1 (Related Art)
FIG. 1 is a circuit diagram illustrating a pixel according to the related art.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to complete understanding of the invention are omitted for clarity. Also, like reference numerals refer to like elements throughout.

Figure 2:
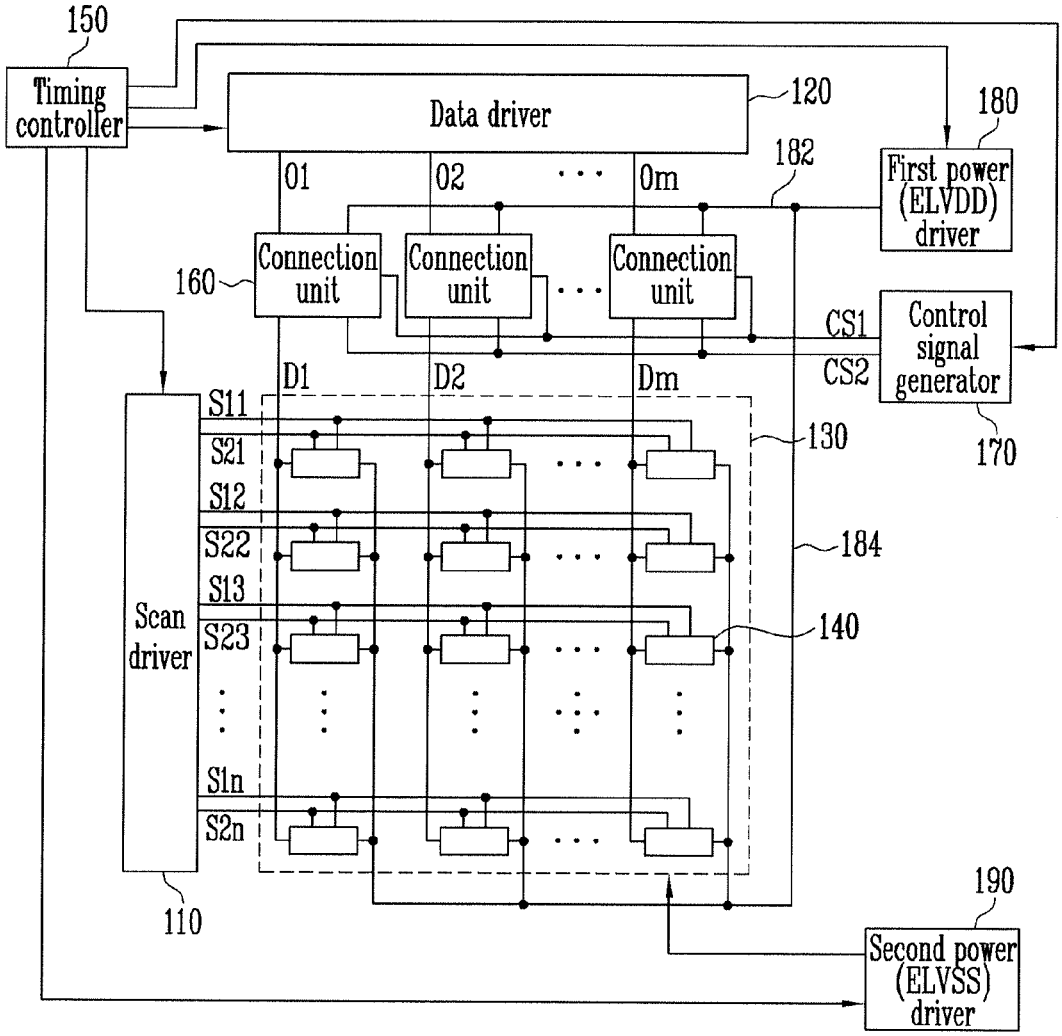
FIG. 2 is a diagram illustrating an organic light emitting display device according to an embodiment of the present invention.

FIG. 2 is a block diagram illustrating an organic light emitting display device according to an embodiment of the present invention.

Referring to FIG. 2, an organic light emitting display device according to an embodiment of the present invention includes a display unit 130 including pixels 140 coupled with first scan lines S11 to S1*n*, second scan lines S21 to S2*n*, and data lines D1 to Dm, a scan driver 110 driving the first scan lines S11 to S1*n* and the second san lines S21 and S2*n*, and a data driver 120 for supplying data signals to output lines O1 to Om.

Further, the organic light emitting display device according to an embodiment of the present invention includes connection units 160 coupled between the output lines O1 to Om and the data lines D1 to Dm, a first power driver 180 for supplying a first power ELVDD to a first power line 182 and to a second power line 184, a second power driver 190 for supplying a second power ELVSS to the pixels 130, a control signal generator 170 for supplying control signals to the connection units 160, and a timing controller 150 for controlling the scan driver 110, the data driver 120, the control signal generator 170, the first power driver 180, and the second power driver 190.

Figure 4:
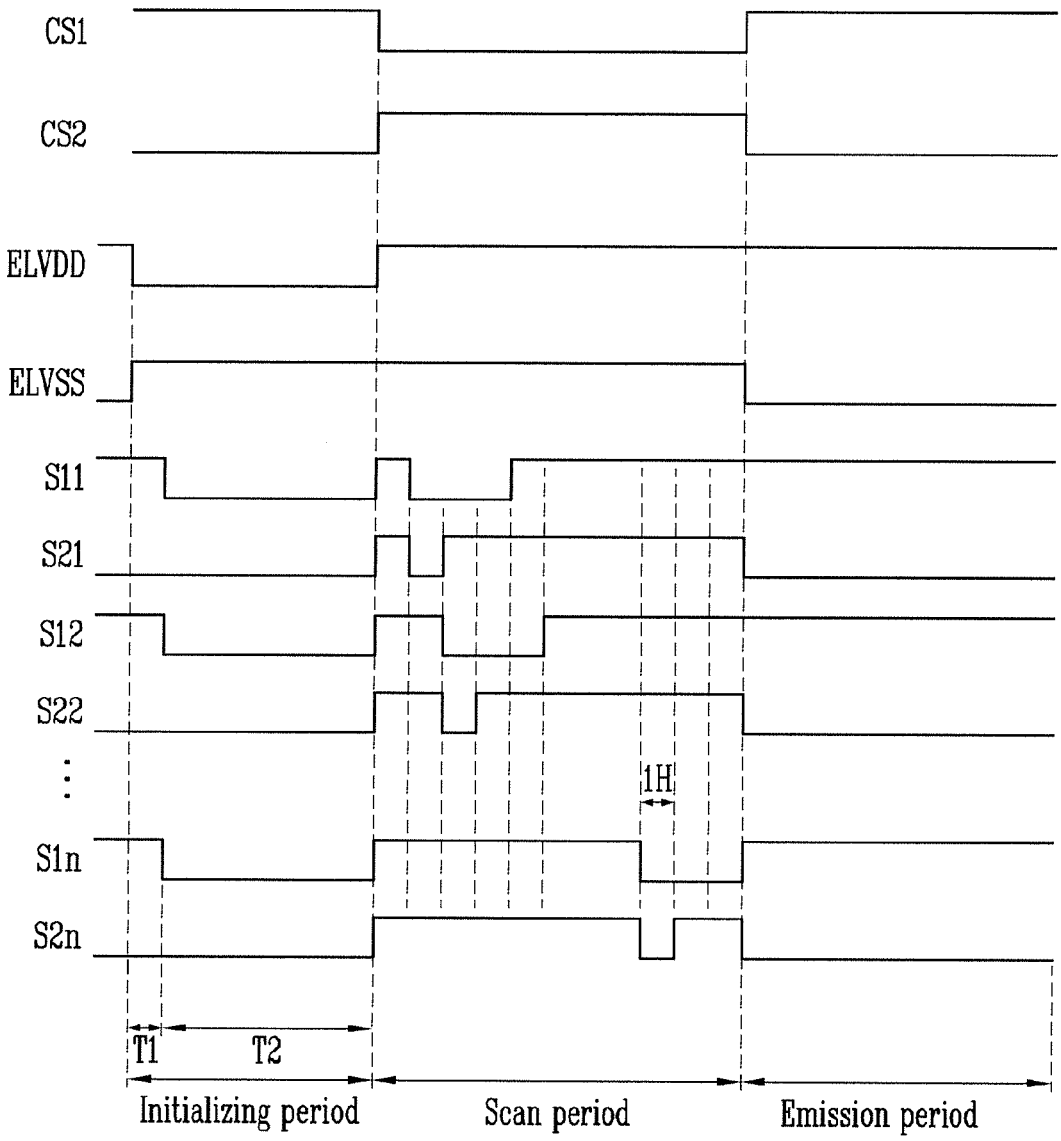
FIG. 4 is a waveform diagram illustrating a method of driving the connection unit and pixel shown in FIG. 3.

According to one embodiment, the scan driver 110 supplies first scan signals to the first scan signal lines S11 to S1n and second scan signals to the second scan lines S21 to S2*n*. The scan driver 100, as shown in FIG. 4, concurrently (e.g., simultaneously) supplies second scan signals to the second scan lines S21 to S2*n* for an initializing period and concurrently (e.g., simultaneously) supplies first scan signals to the first scan lines S11 to S1*n* for a duration of time (e.g., a predetermined period) T2 in the initializing period.

Further, the scan driver 110 sequentially supplies second scan signals to the second scan lines S21 to S2*n* and sequentially supplied first scan signals to the first scan lines S11 to S1*n* for a scan period. The first scan signals supplied for the scan period may have a larger pulse-width than that of the second scan signals. For example, when the second scan signals are supplied for one horizontal period 1H, the first scan signal may be supplied for three horizontal periods 3H. Further, the first scan signals supplied to the i-th (herein, i is a natural number) first scan line S1*i* for the scan period are supplied concurrently (e.g., simultaneously) with the second scan signals supplied to the i-th second scan line S2*i*.

According to one embodiment, data driver 120 supplies data signals to the data lines D1 to Dm to be synchronized with the second scan signals sequentially supplied to the second scan lines S21 to S2*n* for the scan period.

The first power driver 180 supplies power from the first power source ELVDD to the first power line 182 and to the second power line 184. In this configuration, the first power driver 180 supplies a high or low power level during each period of the frame.

For example, the first power driver 180 supplies low-level power of the first power supply ELVDD for the initializing period, and supplies high-level power of the first power supply ELVDD for the scan period and the emission period. The high-level first power ELVDD is set to a voltage where current can flow in the pixel 140 (e.g., a voltage level higher than a data signal) and the low-level first power ELVDD is set to a voltage where current cannot flow in the pixel 140 (e.g., a voltage level lower than the data signal).

The first power line 182 electrically couples the connection unit 160 with the first power driver 180. The second power line 184 electrically couples all of the pixels 140 with the first power driver 180. That is, the second power line 184 supplies the voltage of the first power supply ELVDD to the pixels 140, not through the connection units 160.

In one embodiment, the second power driver 190 supplies power from the second power supply ELVSS to the pixels 140. In this configuration, the second power driver 190 supplies a high level or a low level power (e.g., changes between high level and low level) of the second power supply ELVSS during each frame period. For example, the second power driver 190 supplies high-level power of the second power supply ELVSS for the initializing period and the scan period and supplies low-level power of the second power supply ELVSS for the emission period. The high-level second power ELVSS is set to a voltage level where current cannot flow in the pixel 140 (e.g. a voltage level higher than a data signal) and the low-level second power ELVSS is set to a voltage level where current can flow in the pixel 140 (e.g., a voltage level lower than the data signal).

In one embodiment, the control signal generator 170 generates and supplies first control signals CS1 and second control signals CS2 to the connection units 160. The first control signals CS1 and the second controls signal CS2 are alternately supplied. For example, the control signal generator 170 supplies the second control signals CS2 for the initializing period and the emission period, and the first control signals CS1 for the scan period.

According to one embodiment, the connection unit 160 is coupled between the output line (any one of O1 to Om) and the data line (any one of D1 to Dm). The connection unit couples the data line to any one of the output line (any one of O1 to Om) and to the first power line 182, in response to the first control signal CS1 and the second control signal CS2.

The display unit 130 includes the pixels 140 which are located in the crossing regions of the first scan lines S11 to S1*n* and the data lines D1 to Dm. The pixels 140 are supplied with power from the first power supply ELVDD and the second power supply ELVSS. The pixels 140 controls the amount of current supplied to a second power supply ELVSS through organic light emitting diodes from a first power supply ELVDD, in response to the data signals, during the emission period in one frame period. Accordingly, light (e.g., light having a predetermined luminance) is generated in the organic light emitting diode.

Figure 3:
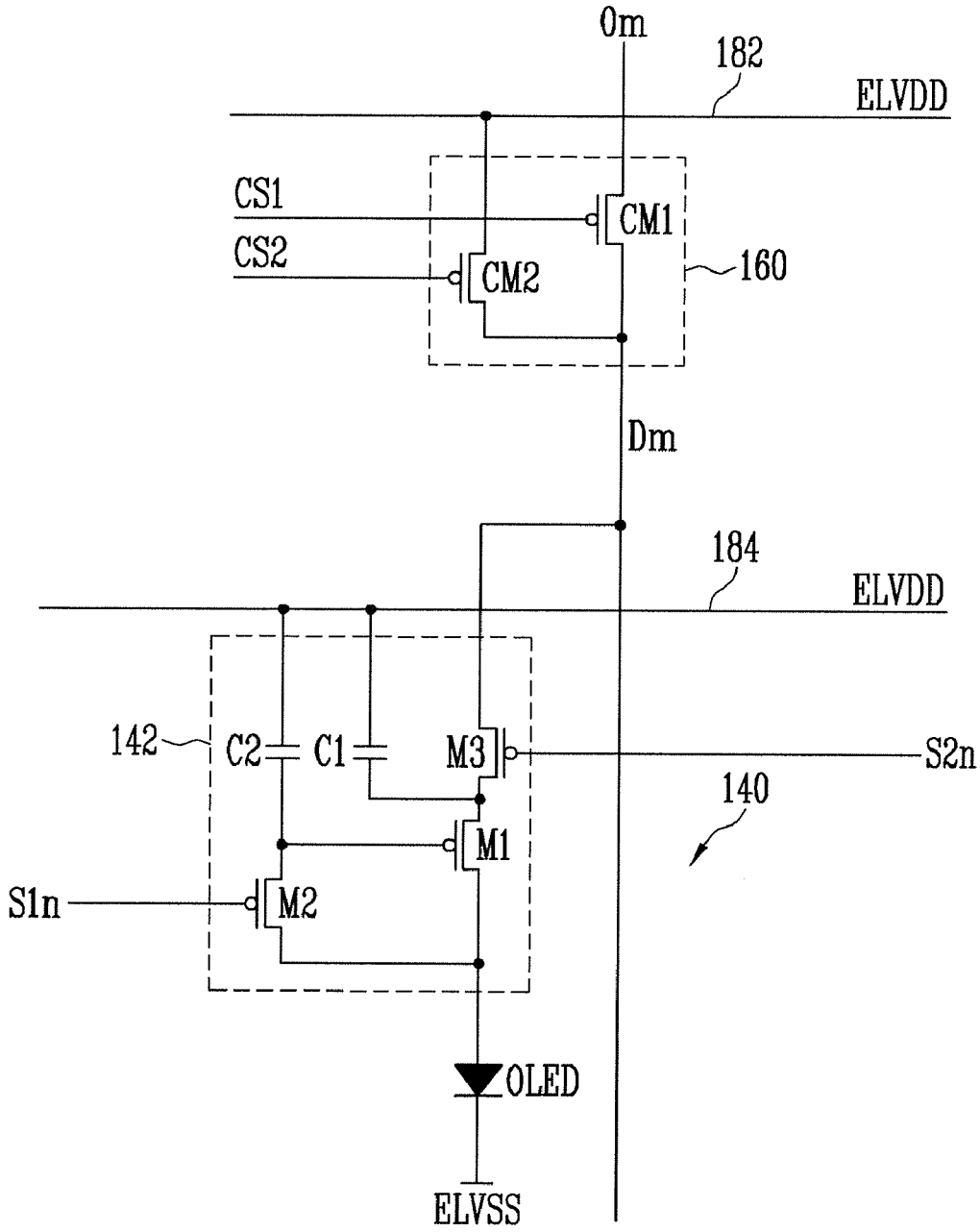
FIG. 3 is a diagram illustrating an embodiment of the connection unit and pixel shown in FIG. 2.

FIG. 3 is a circuit diagram showing an embodiment of the connection units and the pixels according to a first embodiment of the present invention. FIG. 3 shows the connection unit 160 coupled with the m-th output line Om and the pixel 140 coupled with the n-th first scan line S1*n*, for the convenience of description.

Referring to FIG. 3, the connection unit 160, according to the first embodiment of the present invention, includes a first control transistor CM1 and a second control transistor CM2.

The first control transistor CM1 is coupled between the output line Om and the data line Dm. The first control transistor CM1 is turned on when the first control signal is supplied.

The second control transistor CM2 is coupled between the first power line 182 and the data line Dm. The second control transistor CM2 is turned on when the second control signal is supplied. In this configuration, the first control transistor CM1 and the second control transistor CM2 couple the data line Dm to the first power line 182 or the output line Om while being alternately turned on.

Figure 5:
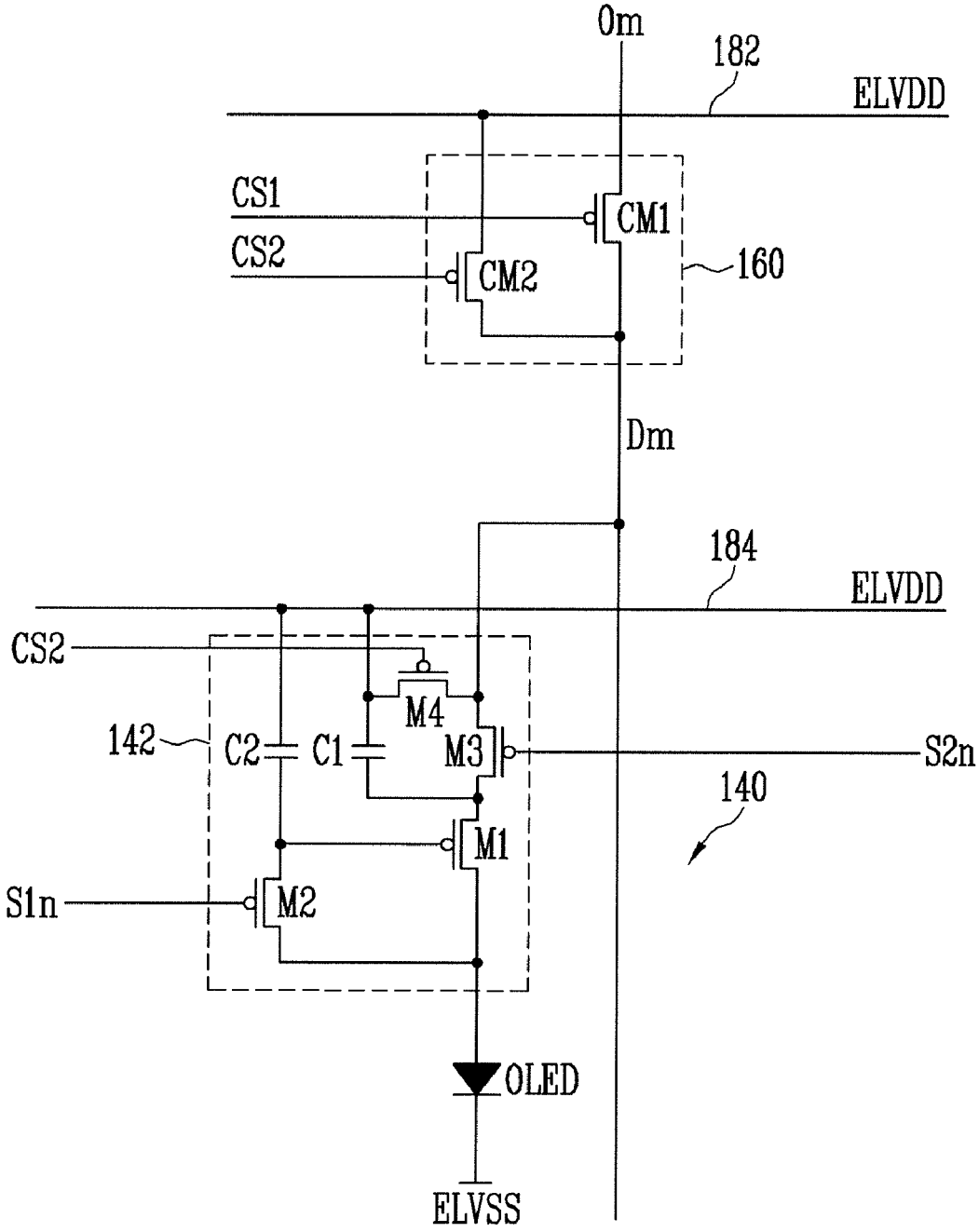
FIG. 5 is a diagram illustrating another embodiment of the pixel shown in FIG. 2.

Referring to FIG. 5, the pixel 140, according to an embodiment of the present invention, includes an organic light emitting diode OLED and a pixel circuit 142 controlling the amount of current supplied to the organic light emitting diode OLED.

The anode electrode of the organic light emitting diode OLED is coupled to the pixel circuit 142 and the cathode electrode is coupled to the second power supply ELVSS. The organic light emitting diode OLED produces light (e.g., light with a predetermined luminance) in response to the current supplied from the pixel circuit 142.

The pixel circuit 142 is charged at voltage corresponding to the data signal and the threshold voltage of the driving transistor, and controls the amount of current supplied to the organic light emitting diode OLED based on the charged voltage. For this operation, the pixel circuit 140 includes first to third transistors M1 to M3, a first capacitor C1, and a second capacitor C2.

A first electrode of the first transistor M1 is coupled to a second electrode of the third transistor M3 and a second electrode is coupled to the anode electrode of the organic light emitting diode OLED. Further, a gate electrode of the first transistor M1 is coupled to a first terminal of the second capacitor C2. The first transistor M1 controls the amount of current supplied to the organic light emitting diode OLED according to the voltage of the charged second capacitor C2.

A first electrode of the second transistor M2 is coupled to a second electrode of the first transistor M1 and a second electrode is coupled to a first terminal of the second capacitor C2. Further, a gate electrode of the second transistor M2 is coupled to the first scan line S1*n*. When a first scan signal is supplied to the first scan line S1*n*, the second transistor M2 is turned on and diode-connects the first transistor M1.

The third transistor M3 is coupled between the data line Dm and the first electrode of the first transistor M1. Further, a gate electrode of the third transistor M3 is coupled to the second scan line S2*n*. When a second scan signal is supplied to the second scan line S2*n*, the third transistor M3 is turned on and electrically couples the first transistor M1 with the data line Dm.

The first capacitor C1 is coupled between the first electrode of the first transistor M1 and the second power line 184. The first capacitor C1 is charged at a voltage level corresponding to the data signal for the scan period.

The second capacitor C2 is coupled between the gate electrode of the first transistor M1 and the second power line 184. In this operation, the second capacitor C2 is charged to a voltage level corresponding to a data signal and a threshold voltage level of the first transistor M1.

FIG. 4 is a waveform diagram illustrating a driving method according to an embodiment of the connection unit and pixel shown in FIG. 3.

Referring to FIG. 4, according to one embodiment, one frame period may be divided into an initializing period, a scan period, and an emission period.

The initializing period is divided into a first period T1 and a second period T2. The anode electrode of the organic light emitting diode OLED is initialized for the first period T1 and the gate electrode of the first transistor M1 is initialized for the second period T2.

The second capacitors C2 in the pixels 140 are charged at voltage level corresponding to a data signal and threshold voltage level of the first transistor M1 for the scan period. Since the second power supply ELVSS is set to a high level for the initializing period and the scan period, the light is not emitted through the pixels 140.

The pixels 140 control the amount of current supplied to the organic light emitting diode OLED according to the voltage of the charged second capacitor C2, for the emission period.

According to one embodiment, the operation in detail, second scan signals are concurrently (e.g., simultaneously) supplied to the second scan lines S21 to S2*n* for the first period T1 in the initializing period. Further, as the second control signals CS2 are supplied for the initializing period, the second control transistor CM2 is turned on.

As the second control transistor CM2 is turned on, the voltage of the low-level first power supply ELVDD is supplied to the data line Dm. As the second scan signals are supplied, the third transistor M3 is turned on. When the third transistor M3 is turned on, the data line Dm and the first electrode of the first transistor M1 are electrically coupled.

The voltage of the anode electrode of the organic light emitting diode OLED becomes higher than the data line Dm by the high-level second power supply ELVSS, such that the voltage of the anode electrode of the organic light emitting diode OLED drops substantially to the voltage of the low-level first power supply ELVDD.

First scan signals are concurrently (e.g., simultaneously) supplied to the first scan lines S11 to S1*n* during the second period T2 in the initializing period. As the first scan signals are supplied, the second transistor M2 is turned on. When the second transistor M2 is turned on, the anode of the organic light emitting diode OLED and the gate electrode of the first transistor M1 are electrically coupled to each other. In this process, the gate electrode of the first transistor M1 drops substantially to the voltage of the anode electrode of the organic light emitting diode OLED.

In detail, the voltage applied to the anode electrode of the organic light emitting diode OLED for the first period T1 is stored in a parasitic capacitor of the organic light emitting diode OLED, which is not shown in the drawings. In this configuration, the parasitic capacitor of the organic light emitting diode OLED is set to have capacity larger than the second capacitor C2. In this process, the gate electrode of the first transistor M1 drops substantially to the voltage of the anode electrode of the organic light emitting diode OLED, for the second period T2.

The first control transistor CM1 is turned on by the first control signal for the scan period. As the first control transistor CM1 is turned on, the data line Dm and the output line Om are electrically coupled to each other. Further, the second scan signals are sequentially supplied to the second scan lines S21 to S2*n*, and the first scan signals are sequentially supplied to the first scan lines S11 to S1*n*, for the scan period.

As the second scan signal is supplied to the n-th second scan line S2*n*, the third transistor M3 is turned on. As the first scan signal is supplied to the n-th first scan line S1*n*, the second transistor M2 is turned on. In this process, a data signal is supplied to the data line Dm. The data signal supplied to the data line Dm is supplied to the first terminal of the second capacitor C2 through the first transistor M1.

In this operation, the second capacitor C2 is charged to a voltage level corresponding to a data signal and threshold voltage level of the first transistor M1. On the other hand, the first capacitor is charged to a voltage level corresponding to the data signal while the third transistor M3 is turned on.

Thereafter, as supply of the second scan signal to the n-th second scan line S2*n* is stopped, the third transistor M3 is turned off. However, the third transistor M3 is kept on, even if the third transistor M3 is turned off. While the second transistor M2 is turned on, the second capacitor C2 is additionally charged to a voltage level corresponding to the data signal and the threshold voltage level of the first transistor M1 according to the data signal supplied to the first capacitor C1. Hence, in one embodiment of the present invention, it is possible to improve the charging time of the second capacitor C2 by using the turning-on time of the second transistor M2, and thus accurately display an image having desired luminance.

The second control signal CS2 is supplied and the second control transistor CM2 is turned on for the emission period, and accordingly, the voltage of the high-level first power supply ELVDD is supplied to the m-th data line Dm. Further, the third transistor M3 is turned on in response to the scan signals supplied to the second scan lines S21 to S2*n* for the emission period. In this case, the first transistor M1 controls the amount of current flowing from the first power supply ELVDD to the second power supply ELVSS through the organic light emitting diode OLED according to the voltage level of the charged second capacitor C2.

FIG. 5 is a circuit diagram illustrating a connection unit and a pixel according to another embodiment of the present invention. In explaining FIG. 5, the same components as in FIG. 3 are designated by the same reference numerals and the detailed description is omitted for brevity.

Referring to FIG. 5, a pixel 140 according to another embodiment of the present invention, further includes a fourth transistor M4 coupled between the data line Dm and the second power line 184.

The fourth transistor M4 is turned on and electrically couples the second power line 184 with the data line Dm, when the second control signal CS2 is supplied. The fourth transistor M4 is turned on for the initializing period and the emission period and electrically couples the first power line 182 with the second power line 184 such that a voltage drop of the first power supply ELVDD is reduced or minimized. The other elements of the driving method are substantially similar to those shown in FIG. 3, and redundant descriptions are omitted for brevity.

While certain exemplary embodiments of the present invention have been described herein, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel comprising:

an organic light emitting diode;

a first transistor having a second electrode coupled to the organic light emitting diode and a first electrode coupled to a data line;

a second transistor coupled between a gate electrode and the second electrode of the first transistor and turned-on when a first scan signal is supplied to a first scan line;

a third transistor coupled between the first electrode of the first transistor and the data line and turned-on when a second scan signal is supplied to a second scan line;

a first capacitor coupled between the first electrode of the first transistor and a first power supply; and a second capacitor coupled between the gate electrode of the first transistor and the first power supply, wherein the data line is configured to receive a data signal from a data driver and a first power from the first power supply at different times, wherein the organic light emitting diode is coupled between the first transistor and a second power supply, and wherein the second power supply is configured to supply a second power at a first level for an initialization period and a scan period of a frame, and to supply the second power at a second level that is lower than the first level for an emission period of the frame.

2. The pixel as claimed in claim 1, wherein the second transistor and the third transistor are concurrently turned on for one frame period while the second capacitor is charged.

3. The pixel as claimed in claim 2, wherein the second transistor is turned on for a longer time than the third transistor during a scan period.

4. The pixel as claimed in claim 2, further comprising a fourth transistor coupled between the first power supply and the data line and turned on in periods other than a scan period.

5. An organic light emitting display device of which one frame period is divided into an initializing period, a scan period, and an emission period, the organic light emitting display device comprising:

a pixel unit comprising pixels coupled with first scan lines, second scan lines, and data lines;

a data driver for driving output lines;

a first power driver for supplying first power, changing to a low level and a high level during the frame period, to a first power line and a second power line, the second power line coupled to the pixels;

connection units coupled between the output lines and data lines and between the first power line and the data lines, the connection units for connecting the data lines with the first power line and one of the output lines; and a second power driver for supplying a second power, changing to a low level and a high level during the frame period, to the pixels.

6. The organic light emitting display device as claimed in claim 5, wherein the first power driver is configured to supply the first power at the low level for the initializing period and to supply the first power at the high level for the scan period and the emission period.

7. An organic light emitting display device of which one frame period is divided into an initializing period, a scan period, and an emission period, the organic light emitting display device comprising:

a pixel unit comprising pixels coupled with first scan lines, second scan lines, and data lines;

a data driver for driving output lines;

a first power driver for supplying first power, changing to a low level and a high level during the frame period, to a first power line and a second power line, the second power line coupled to the pixels;

connection units coupled between the output lines and data lines, the connection units for connecting the data lines with the first power line and one of the output lines; and a second power driver for supplying a second power, changing to a low level and a high level during the frame period, to the pixels, wherein the second power driver is configured to supply the second power at the high level for the initializing period and the scan period, and to supply the second power at the low level for the emission period.

8. An organic light emitting display device of which one frame period is divided into an initializing period, a scan period, and an emission period, the organic light emitting display device comprising:

a pixel unit comprising pixels coupled with first scan lines, second scan lines, and data lines;

a data driver for driving output lines;

a first power driver for supplying first power, changing to a low level and a high level during the frame period, to a first power line and a second power line, the second power line coupled to the pixels;

connection units coupled between the output lines and data lines, the connection units for connecting the data lines with the first power line and one of the output lines; and a second power driver for supplying a second power, changing to a low level and a high level during the frame period, to the pixels, wherein each of the pixels comprises:

an organic light emitting diode;

a first transistor comprising a second electrode coupled to the organic light emitting diode and a first electrode coupled to a data line;

a second transistor coupled between a gate electrode and the second electrode of the first transistor, and being configured to turn on when a first scan signal is supplied to a first scan line;

a third transistor coupled between the first electrode of the first transistor and the data line, and being configured to turn on when a second scan signal is supplied to the second scan line;

a first capacitor coupled between the first electrode of the first transistor and a second power line; and a second capacitor coupled between the gate electrode of the first transistor and the second power line.

9. The organic light emitting display device as claimed in claim 8, wherein the scan driving unit concurrently supplies second scan signals to the second scan lines for the initializing period and the emission period, and sequentially supplies the second scan signals to the second scan lines for the scan period.

10. The organic light emitting display device as claimed in claim 9, wherein the scan driving unit concurrently supplies first scan signals to the first scan lines for a period in the initializing period, and sequentially supplies the first scan signals to the first scan lines for the scan period.

11. The organic light emitting display device as claimed in claim 10, wherein the first scan signal supplied to an i-th (i is a natural number) first scan line of the first scan lines for the scan period is supplied concurrently with the second scan signal supplied to an i-th second scan line of the second scan lines, and the first scan signal is supplied for a time longer than the second scan signal.

12. The organic light emitting display device as claimed in claim 8, further comprising a control signal generator for supplying a first control signal corresponding to a connection between the data line and the output line for the scan period, and a second control signal corresponding to a connection between the data line and the first power line for the initializing period and for the emission period to the connection unit.

13. The organic light emitting display device as claimed in claim 12, wherein the pixels each further comprise a fourth transistor coupled between the second power line and the data line and turned on when the second control signal is supplied.

14. The organic light emitting display device as claimed in claim 12, wherein the connection unit comprises:

a first control transistor coupled between the output line and the data line and being configured to turn on when the first control signal is supplied; and a second control transistor coupled between the first power line and the data line and being configured to turn on when the second control signal is supplied.

* * * * *